US008615907B2

(12) United States Patent
Miller et al.

(10) Patent No.: US 8,615,907 B2
(45) Date of Patent: Dec. 31, 2013

(54) REACH AND PULL ACTION LOADER GRAPPLE

(75) Inventors: Timothy D. Miller, Sioux Falls, SD (US); Michael L. Feilmeier, Jefferson, SD (US)

(73) Assignee: Agile Manufacturing, LLC, Larchwood, IA (US)

( * ) Notice: Subject to any disclaimer, the term of this patent is extended or adjusted under 35 U.S.C. 154(b) by 781 days.

(21) Appl. No.: 12/877,416

(22) Filed: Sep. 8, 2010

(65) Prior Publication Data

US 2011/0318158 A1 Dec. 29, 2011

Related U.S. Application Data

(60) Provisional application No. 61/358,578, filed on Jun. 25, 2010.

(51) Int. Cl.
*E02F 3/413* (2006.01)

(52) U.S. Cl.
CPC ..... *E02F 3/413* (2013.01); *E02F 3/4133* (2013.01); *E02F 3/4136* (2013.01); *Y10S 414/13* (2013.01)
USPC ..... 37/406; 172/615; 172/624.5; 414/724; 414/729; 414/732; 414/738; 414/739; 414/917; 294/106

(58) Field of Classification Search
CPC ..... E02F 3/413; E02F 3/4131; E02F 3/4133; E02F 3/4135; E02F 3/4136
USPC ..... 37/406; 294/106; 414/722, 724, 729, 414/732, 738, 739, 741, 912, 917; 172/307, 172/615, 624.5
See application file for complete search history.

(56) References Cited

U.S. PATENT DOCUMENTS 5,957,650 A 9/1999 Rollo
7,160,077 B2 1/2007 Westendorf et al.
7,241,101 B2 7/2007 Bauer et al.

*Primary Examiner* — Saul Rodriguez
*Assistant Examiner* — Brendan Tighe
(74) *Attorney, Agent, or Firm* — McKee, Voorhees & Sease, P.L.C.

(57) ABSTRACT

A grapple device includes a torque tube, a pivot, a rod and cylinder, a pivot link, and a tooth. The torque tube has first and second torque pivot points and is adapted to be mounted on a bucket. The pivot is rotatably connected to the first torque pivot point at a pivot cross tube located at a second end of the pivot, and the pivot further comprises a pivot collar at a first end, and first and second pivot faces adjacent the pivot collar. The rod and cylinder are operatively connected to the second torque pivot point, includes a rod and a cylinder, and has a rod pivot at a first end of the rod.

6 Claims, 9 Drawing Sheets

REACH AND PULL ACTION LOADER GRAPPLE

CROSS-REFERENCE TO RELATED APPLICATIONS

This application claims priority under 35 U.S.C. §119 of a provisional application Ser. No. 61/358,578 filed Jun. 25, 2010, which application is hereby incorporated by reference in its entirety.

FIELD OF THE INVENTION

The present invention relates to front-loaders, bucket loaders, or similar equipment. More specifically, but not exclusively, the present invention relates to a reach and pull action loader grapple for use with such a loader.

BACKGROUND OF THE INVENTION

Various types of loaders are available which include buckets. Although useful, there are meaningful limitations on the ability to handle certain types of loads. A grappling arm or grapple may be used to improve the ability to handle certain types of awkward loads. Yet, a grapple can also lead to obstructed views and may be easily damaged.

Another problem with existing grapples is the limited amount of forward reach, as measured from the primary grapple pivot point to the anticipated load or object. Grapples may start from a generally upright position, and are lowered in a downward motion that squeezes the material from the top (or in some cases the top side) with the hope that the clamping action holds material in place. Some grapples have a motion such that when they are closed they rotate into the bucket. This rotation is proportional to the distance lowered. Current methods rely on gravity and/or linkages to control the movements of the grapple components. These types of mechanisms intrude into the available working space, may obstruct view, and may also reduce the amount of force able to bring the end of the grapple back towards the bucket to grab the material. Grapples that proportionally rotate as they are lowered, can not reach beyond the arc defined by their single axis of rotation and thus do not maximize the amount of material they can grab.

What is needed is an improved grapple which allows for grabbing larger objects while not intruding into the available working space for the object or obstructing view. Another need is a controlled way to lower a grapple to ensure that the end of the grapple is able to reach out as far as possible, while still being able to be brought back towards the bucket to grab the object or material, and maintaining full reach for the duration of the grapple closing cycle.

BRIEF SUMMARY OF THE INVENTION

Therefore, it is a primary object, feature, or advantage of the present invention to improve over the state of the art.

It is a further object, feature, or advantage of the present invention to provide a grapple that unfolds as it opens and folds as it closes in a controlled manner so as to allow for grabbing larger objects without losing the ability to manipulate and grab smaller objects.

These and/or other objects, features, or advantages of the present invention will become apparent from the specification and claims that follow. No single embodiment need exhibit all of these objects, features, and advantages.

According to one aspect of the present invention, a grapple device for picking up large amounts of material is provided. The grapple device includes a torque tube, a pivot, a rod and cylinder, a pivot link, and a tooth. The torque tube has first and second torque pivot points and is adapted to be mounted on a bucket. The pivot is rotatably connected to the first torque pivot point at a pivot cross tube located at a second end of the pivot. The pivot also comprises a pivot collar at a first end and first and second pivot faces adjacent the pivot collar. The rod and cylinder is operatively connected to the second torque pivot point, and has a rod pivot point at a first end of the rod. The pivot link is operatively connected to the pivot at the pivot collar and the rod at the rod pivot point, and the pivot link comprises two stops at a first end of the pivot link. The tooth member is operatively connected to the pivot link and is adapted to pick up a material.

According to another aspect of the present invention, a method of closing a grapple using a reach and pull movement to grab the most amount of material possible is provided. The method includes providing a grapple device including a torque tube, a pivot rotatably connected to the torque tube, a rod and cylinder operatively connected to the torque tube, a pivot link operatively connected to the pivot, and a tooth member operatively connected to the pivot link. The rod is extended. The rod and cylinder and the pivot are rotated about the torque tube and the pivot link is maintained in the full reach position by the pivot until a pivot angle stop of the pivot abuts the torque tube. Finally, the pivot link is rotated about the pivot until a stop of the pivot link abuts the pivot to bring the tooth into contact with a bucket.

According to another aspect of the present invention, a grapple device for picking up large amounts of materials is provided. The grapple device includes a torque tube having a first torque pivot point and a second torque pivot point, the torque tube adapted to be mounted on a bucket. There is a pivot having a first end and an opposite second end. The pivot is rotatably connected to the first torque pivot point at a pivot cross tube located at the second end of the pivot, the pivot further having a pivot collar at the first end with first and second pivot faces adjacent the pivot collar. There is also a rod and cylinder operatively connected to the second torque pivot point and having a rod pivot point at the first end of the rod. There is a pivot link operatively connected to the pivot at the pivot collar and the rod at the rod pivot, the pivot link comprising two stops at a first end of the pivot link. A tooth member is operatively connected to the pivot link. Guide arms are operatively connected to the cylinder and a guide pin is adapted to move along the guide arms. In a fully open position, the rod is withdrawn within the cylinder, the guide pin of the pivot is positioned in a guide vee of the guide arms such that the pivot does not rotate counterclockwise about the first torque pivot point of the torque tube.

DETAILED DESCRIPTION OF THE PREFERRED EMBODIMENT

Figure 1A:
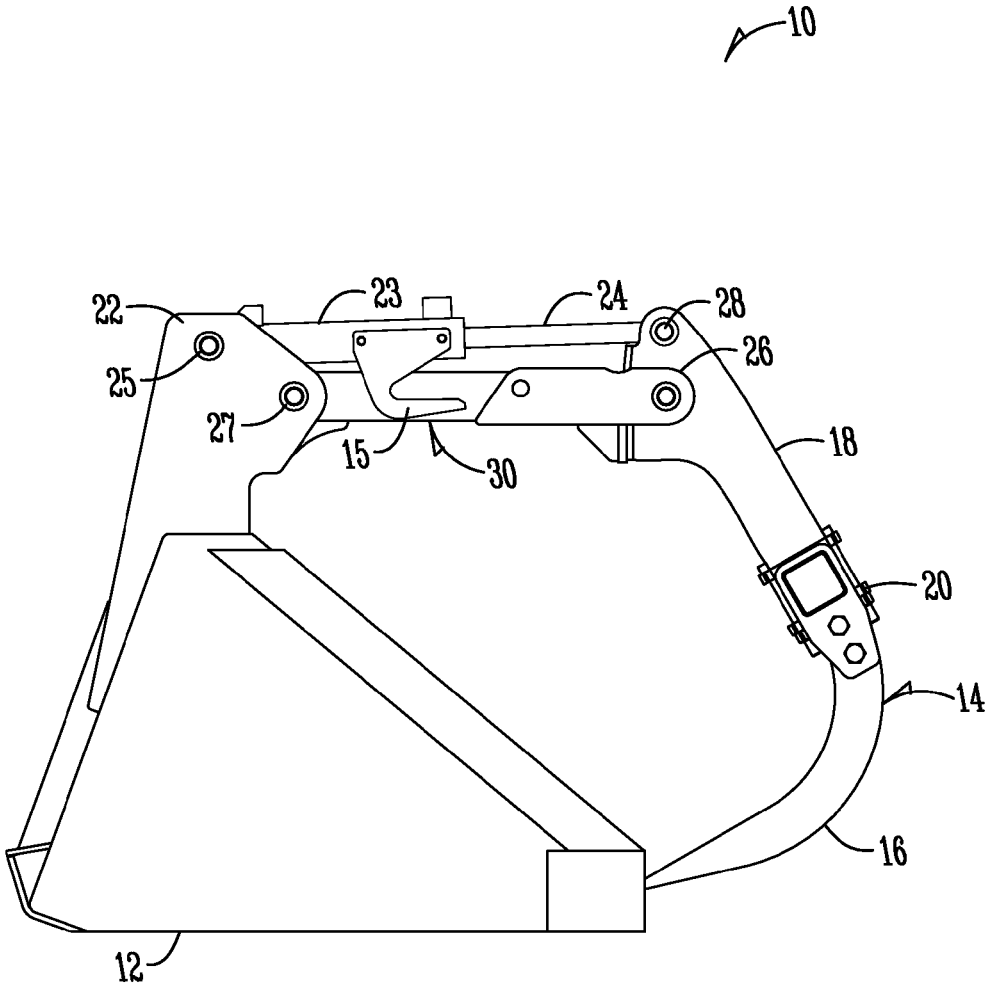
FIG. 1A to FIG. 1E illustrate a grappling device in various positions.

FIG. 1A to FIG. 1E illustrate a grappling device 10 in different positions. As shown in FIG. 1A, a bucket or scoop 12 is shown, which is associated with a loader (not shown). The device 10 includes a closed connecting member 14, which includes a tooth or finger 16 which is operatively connected by a connecting member 20 to a pivot link 18. The pivot link 18 is operatively connected at a first pivot link pivot point 26 to a pivot 30, which is also connected to a torque tube 22. A cylinder 23 with rod 24 is operatively connected between the torque tube 22 and the pivot link 18 at a second pivot link pivot point 28 of the pivot link 18. The torque tube is connected to the scoop 12. The torque tube may be mounted on the scoop or bucket, or attached in another manner which securely holds the torque tube to the scoop. Additionally it maybe attached in a manner to allow quick removal and reattachment.

Figure 2A:
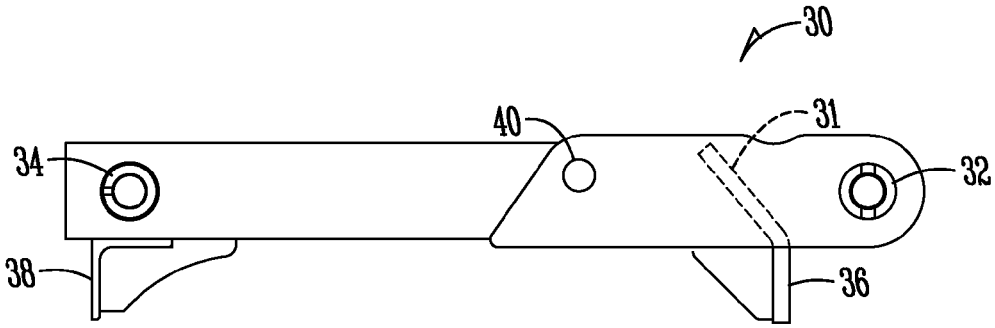
FIG. 2A to FIG. 2C illustrate a pivot of the grappling device used to control movement of the device.
Figure 2B:
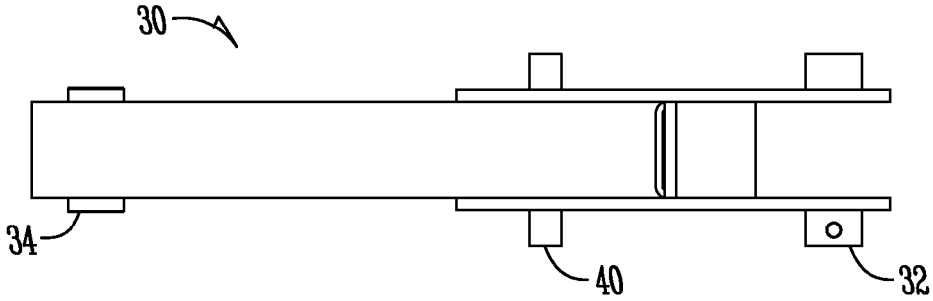
Figure 2C:
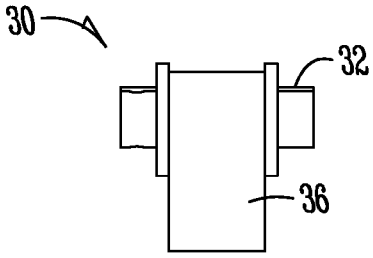

FIG. 2A to FIG. 2C show multiple views of the pivot 30 of the grappling device 10. FIG. 2A shows a front view of the pivot 30. At a first end of the pivot 30 is a pivot collar 32. As shown in FIGS. 2B and 2C, the pivot collar 32 includes a pair of tubular extrusions extending from the sides of the pivot 30. Also at a first end of the pivot 30 and extruding downwardly and facing forwardly is a substantially planar first pivot face 36. Near the first end of the pivot 30 and on the upper side is a substantially planar second pivot face 31. Both pivot faces 31 and 36 are adapted to control the rotation of a pivot link, as will be explained in greater detail below. Extending from the sides of the pivot 30 approximately midway of the pivot is a guide pin 40. At a second end of the pivot 30 and extending from both sides is a pivot cross tube 34. Additionally, extending downwardly and facing rearwardly at the second end of the pivot 30 is a pivot angle stop 38.

Figure 3A:
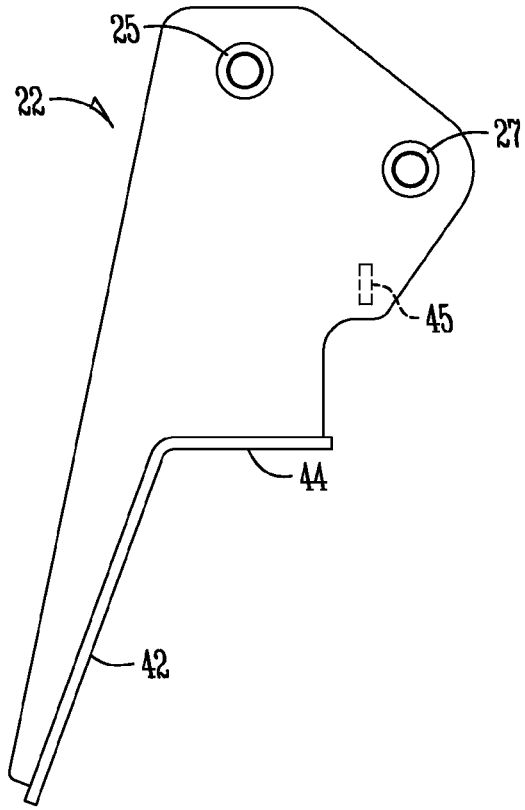
FIG. 3A to FIG. 3C illustrate various views of a torque tube of the grappling device of the present invention.
Figure 3B:
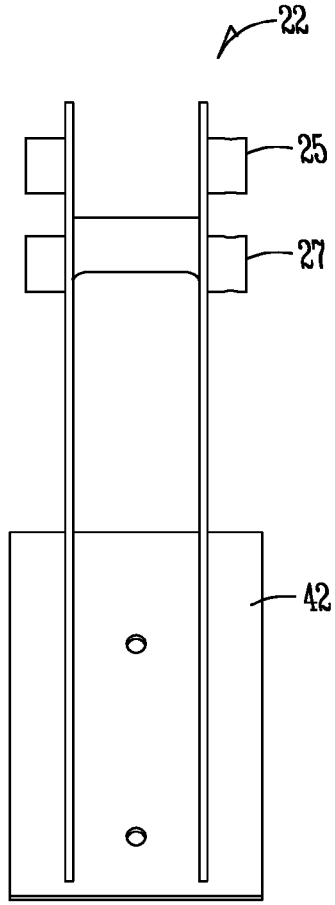
Figure 3C:
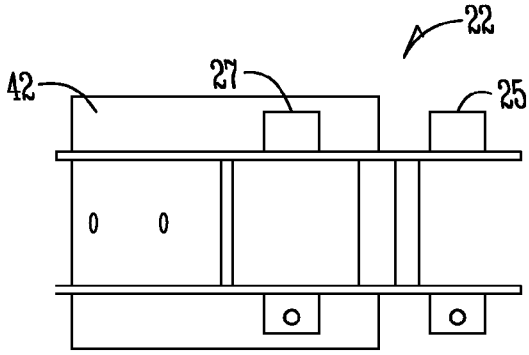

FIG. 3A to FIG. 3C show multiple views of the torque tube 22 of the grappling device 10. The torque tube comprises a first torque pivot point 27 and a second torque pivot point 25, which are configured to operatively connect the torque tube 22 to both the cylinder 23 and the pivot 30. The torque pivot points 25, 27 are adapted to allow the cylinder 23 and pivot 30 to rotate about the pivot points throughout the process of opening and closing the grappling device 10. The torque tube 22 further comprises a mounting face 42 and a resting face 44 for mounting the assembly to a scoop 12 and stop 45. The mounting face 42 may include holes (or a pinned connection) for attaching the assembly to the scoop.

Figure 4A:
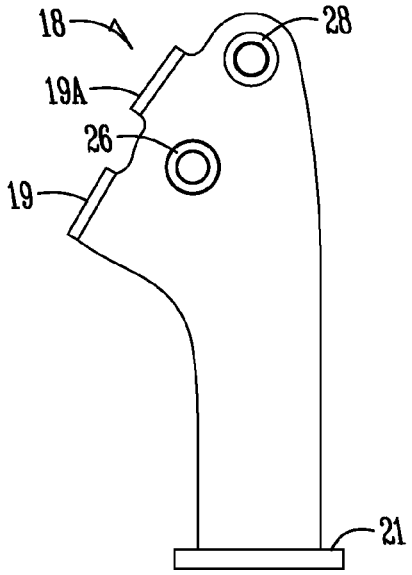
FIG. 4A to FIG. 4C illustrate various views of a pivot link of the grappling device of the present invention.
Figure 4B:
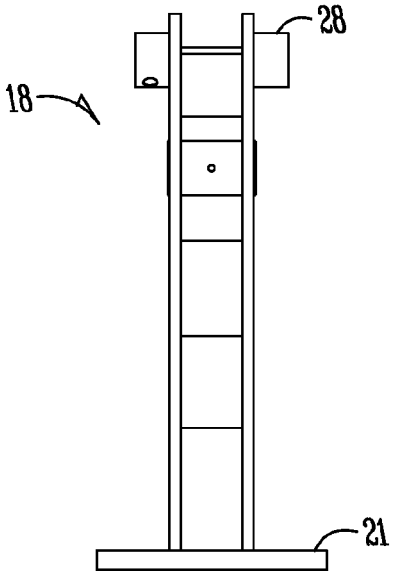
Figure 4C:
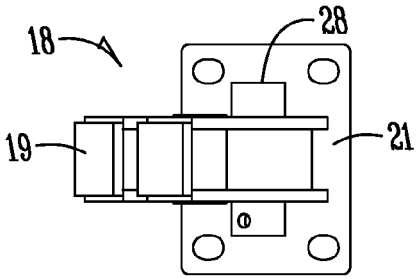
Figure 5:
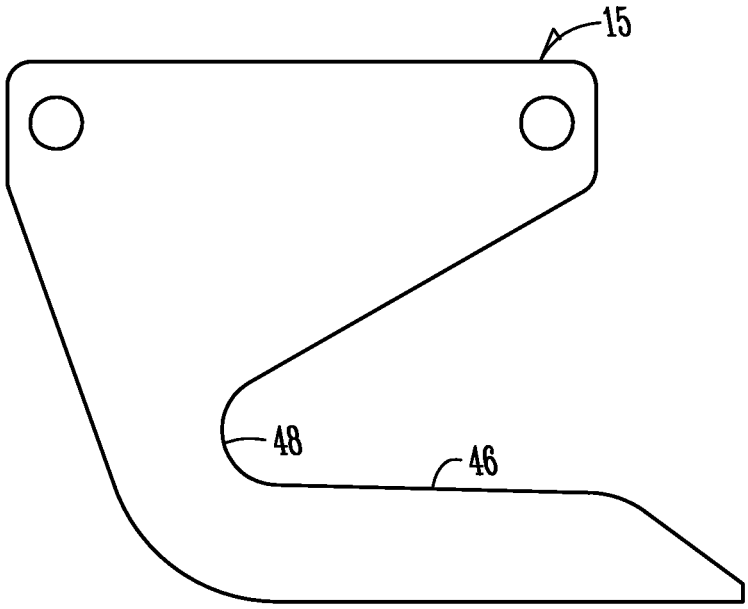
FIG. 5 is a view of a guide arm having a guide face and a guide vee.

FIG. 4A to FIG. 4C show multiple views of the pivot link 18 of the grappling device 10 of the present invention. The pivot link 18 comprises a plurality of stops 19 at one end of the link. Near the stops 19 is a first pivot link pivot point 26, which is a tubular cutout through the link for operatively connecting the pivot link to the pivot 30. Also included near the stop 19 is a second pivot link pivot point 28 for operatively connecting the pivot link to the rod 24. At an opposite end of the link is a clamp plate 21, which is configured to connect the link to the connecting member 20.

As best shown when comparing FIG. 1A to FIG. 1E, the device 10 provides a reach and pull movement. Linear movement of the cylinder creates rotational movement of the grapple 10. During the closing rotational movement of the grapple 10, it is the relationship and interaction of the pivot, pivot link, and guide arms which dictate how the full reach position is maintained followed by a properly timed pull motion.

FIG. 1A shows the grappling device 10 in a fully closed position. At this position, the rod 24 and cylinder 23 are fully extended. The tooth 16 has been rotated into engagement with one end of the scoop 12, which provides for a secure grip to pick items up and to carry the items. Additionally, the stop 19 of the pivot link 18 contacts the first pivot face 36, such that the pivot link 18 is not able to further rotate about the first pivot link pivot point 26 in a clockwise motion.

Figure 1B:
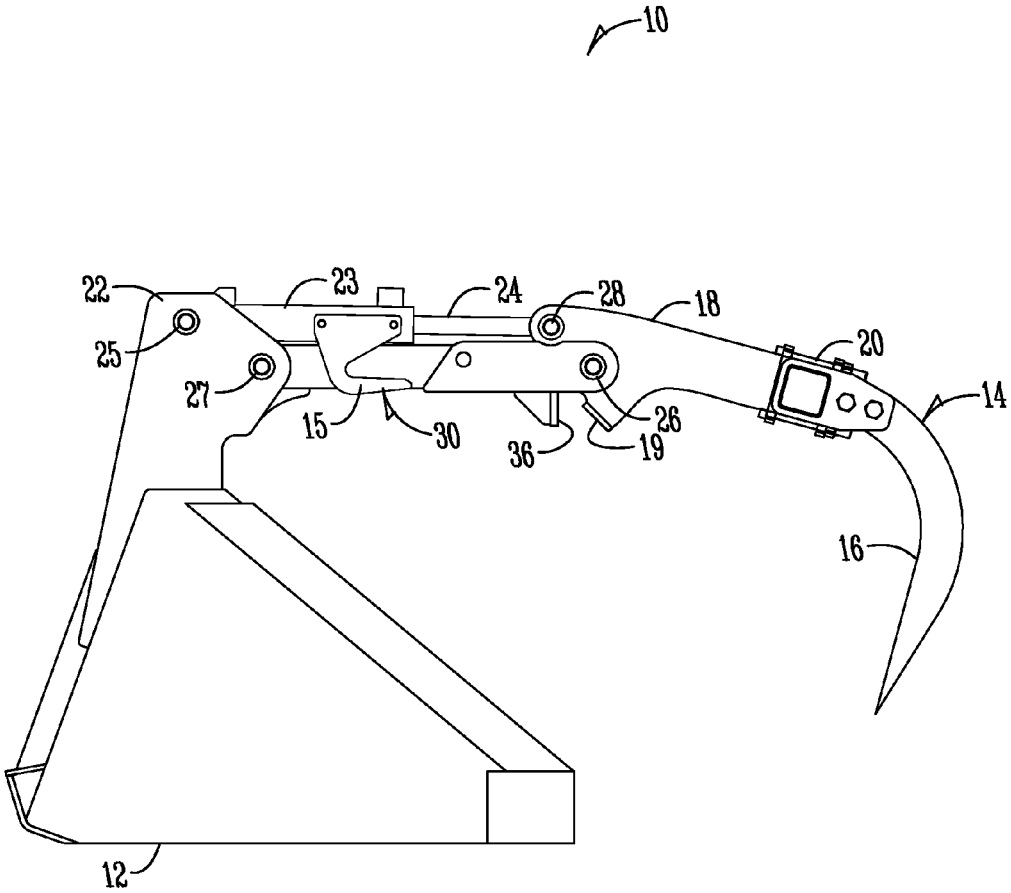

FIG. 1B shows the grappling device as the tooth 16 begins to open. The tooth opens by retracting the rod 24 into the cylinder 23. Because the pivot 30 is a fixed length, the tooth 16 will first rotate about the first pivot link pivot point 26 of the pivot link 18. The tooth 16 will rotate in counterclockwise direction as the rod 24 is retracted within the cylinder 23. The rotation occurs until the stop 19A of the pivot link 18 contacts second pivot face 31 of the pivot 30. At this point, the tooth 16 is not able to further rotate in a counterclockwise direction about the first pivot link pivot point 26 of the pivot link 18.

Figure 1C:
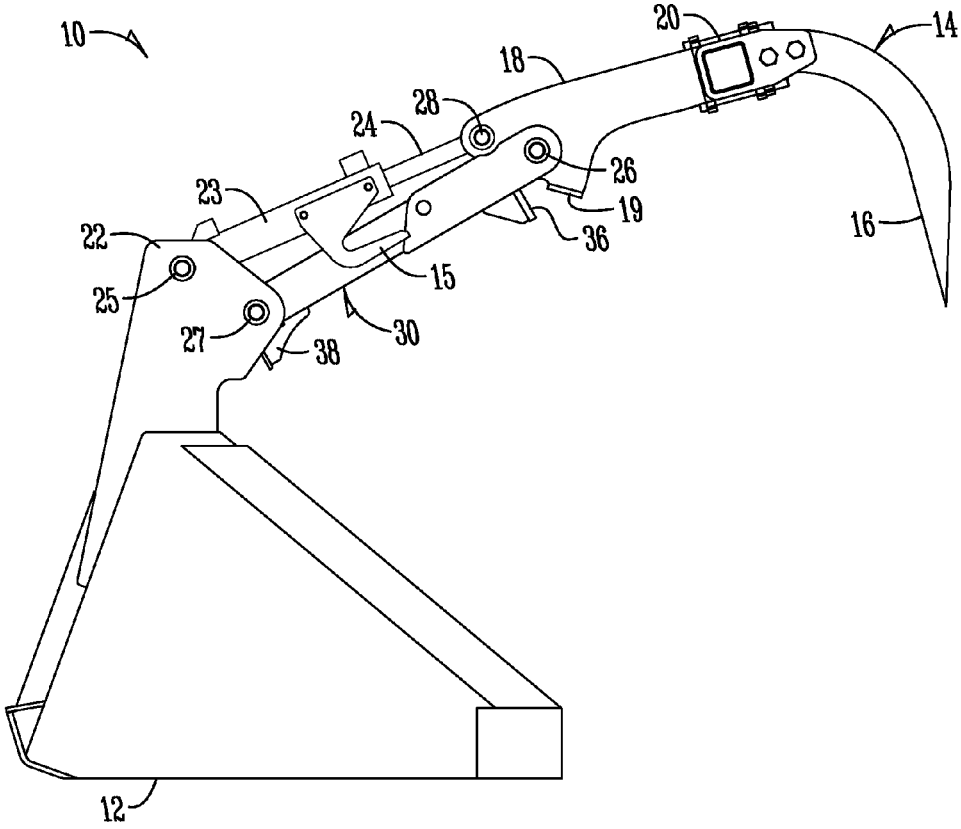

FIG. 1C shows the grappling device 10 as the rod 24 further retracts within the cylinder 23 after the stop 19A has come into contact with the second pivot face 31 of the pivot 30. As the rod 24 further retracts within the cylinder 23, the cylinder and the pivot 30 begin to rotate together in counterclockwise direction about the first and second pivots 25, 27 of the torque tube 22. The cylinder 23 and pivot cross tube 34 are configured to receive the first and second torque pivot points 25, 27 such that that the cylinder and the pivot are able to rotate relative to the fixed torque tube 22, which is mounted on the scoop 12.

Figure 1D:
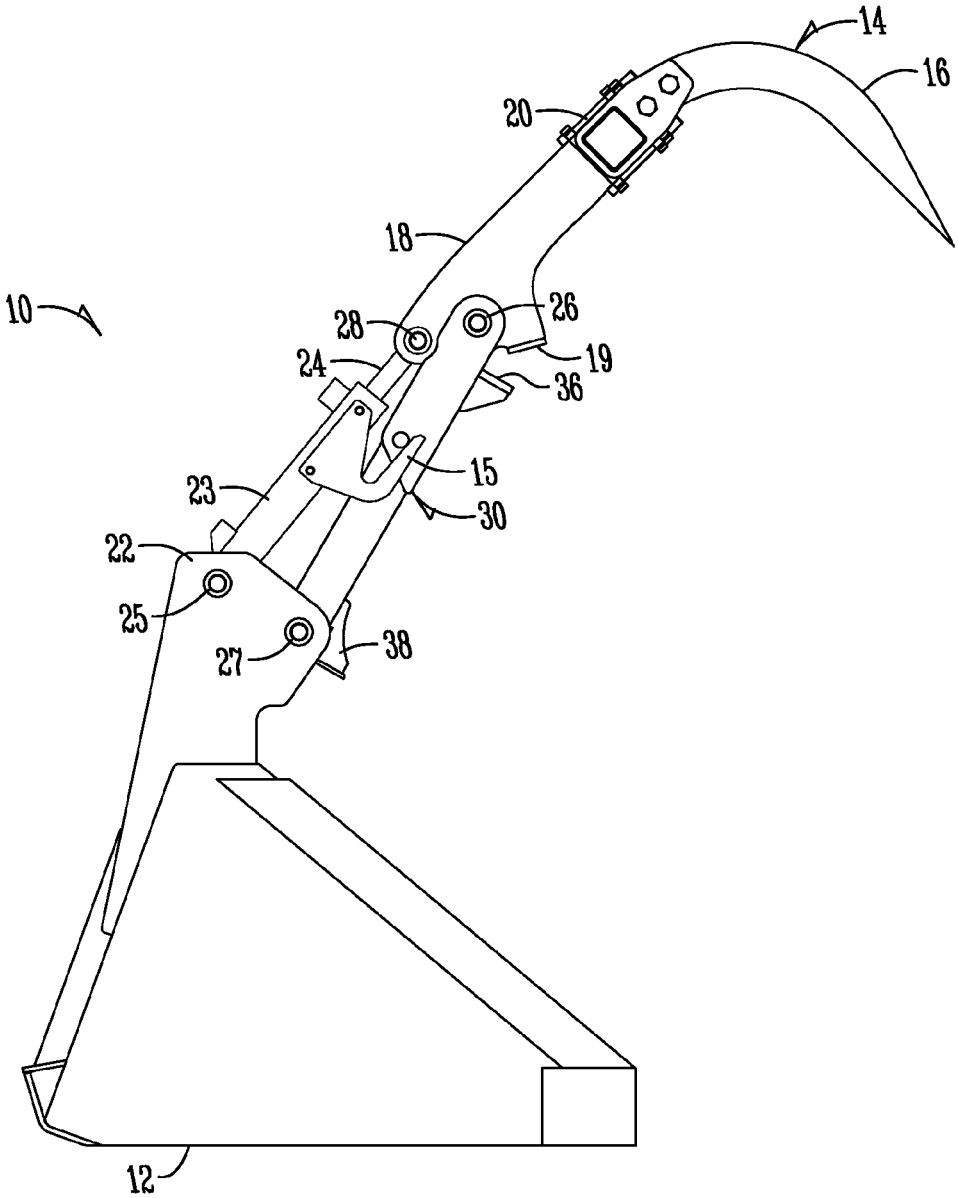

As shown in FIG. 1D, the rod 24 will continue to retract within the cylinder 23 to further open the grappling device 10. The cylinder 23 and the pivot 30 continue to rotate in a counterclockwise direction as the rod 24 is retracted. At a position where the device 10 is approximately 50 degrees, the guide pin 40 of the pivot 30 will engage one or a pair of guide arms 15, which are positioned on opposite sides of the cylinder 23.

Figure 1E:
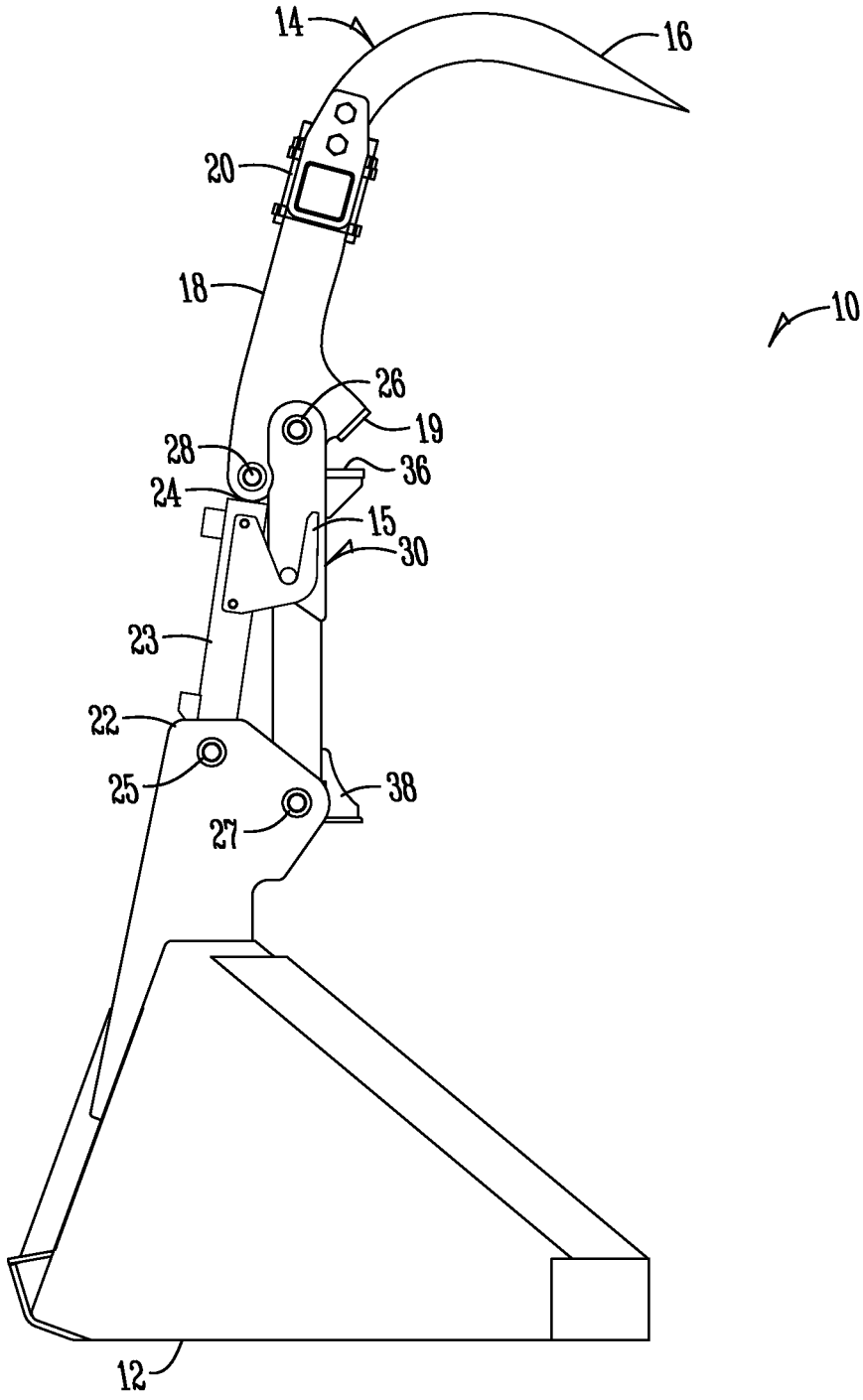

FIG. 1E shows the grappling device 10 in a fully opened position. At the fully opened position, the rod 24 will be fully withdrawn within the cylinder 23. The guide pin 40 of the pivot 30 is now positioned in the guide vee 48 of the guide arms 15 such that the pivot 30 is no longer able to rotate counterclockwise about the first torque pivot point 27 of the torque tube 22. The grappling assembly is extended generally 90° from the ground. Having the tooth 16 open as such allows the grappling assembly 10 to be able to grasp a large amount of material upon closing.

The guide arms 15 in conjunction with the guide pin 40 of the pivot 30 hold the grapple 10 in a "Teeth Open" position from the start of the closing cycle through the transitional range. Additionally, when the grapple 10 is opened the guide arms 15 and guide pin 40 of the pivot arm 30 also perform the task of being the "Opening Stop" as long as the guide pin 40 is engaged in the guide vee 48.

To close, the process works in reverse. The cylinder 23 will extend to close the grapple, initiating the "reach and pull" movement. As the cylinder 23 extends, the pivot 30 rotates clockwise around pivot point 27 from its approximately vertical position from the ground. The rotational motion of pivot link 18 and tooth 16 is constrained to first torque pivot point 27 exclusively, due to the contact between guide point 40 and guide face 46. The guide arms 15 restrain clockwise rotation of the pivot link 18 about the pivot 26 caused by gravity acting on the grapple mass to the right of the pivot 26, thus preserving the full reach capability of the grapple 10 as it closes. Once the pivot 30 has rotated to a position approximately 50 degrees from the ground, the tendency of gravity to rotate the pivot link 18 about the pivot 26 subsides and the contact between the guide pin 40 and guide face 46 is no longer necessary. The full reach capability of the grapple 10 is maintained by the contact between stop 19A and the second pivot face 31 as well as the tendency of the cylinder 23 to rotate the pivot 30 about the pivot first torque pivot point 27 from this position onward. This condition exists until the pivot 30 is horizontal with the ground and pivot angle stop 38 contacts stop 45 of the torque tube 22. As the cylinder 23 continues to open, its motion is translated into rotational motion of the pivot link 18 and the tooth 16 until the stop 19 of the pivot link hit the first pivot face 36 of the pivot 30, "pulling" the load into the scoop 12.

The invention has been shown and described above with reference to preferred embodiments, and it is understood that modifications, substitutions, and additions may be made which are within the intended spirit and scope of the invention. The invention is only to be limited by claims appended hereto.

The invention claimed is:

1. A grapple device for picking up large amounts of materials, comprising:

a torque tube having a first torque pivot point and a second torque pivot point, the torque tube adapted to be mounted on a bucket;

a pivot having a first end and an opposite second end, the pivot rotatably connected to the first torque pivot point at a pivot cross tube located at the second end of the pivot, the pivot further having a pivot collar at the first end with first and second pivot faces adjacent the pivot collar;

a rod and cylinder operatively connected to the second torque pivot point and having a rod pivot point at a first end of the rod;

a pivot link operatively connected to the pivot at the pivot collar and the rod at the rod pivot, the pivot link comprising two stops at a first end of the pivot link;

a tooth member operatively connected to the pivot link;

guide arms operatively connected to the cylinder, a guide pin adapted to move along the guide arms;

wherein, in a fully open position, the rod is withdrawn within the cylinder, the guide pin of the pivot is positioned in a guide vee of the guide arms such that the pivot does not rotate counterclockwise about the first torque pivot point of the torque tube.

2. The grapple device of claim 1 wherein the device enables a reach and pull movement for grabbing material.

3. The device of claim 1 wherein the pivot link is rotatable about both the rod pivot point and the pivot collar.

4. The device of claim 1 wherein the pivot link is adapted to rotate in a clockwise direction relative to the pivot until the at least one stop abuts the first pivot face of the pivot.

5. The device of claim 1 wherein the rod and cylinder are rotatable about the second torque pivot point.

6. The device of claim 1 wherein the pivot further comprises a pivot angle stop configured to stop clockwise rotation of the pivot relative to the torque tube.

* * * * *